United States Patent [19]

Sleep, Jr.

[11] Patent Number: 4,773,475

[45] Date of Patent: Sep. 27, 1988

[54] DISASSEMBLEABLE CORE HEAT EXCHANGER

[76] Inventor: Robert E. Sleep, Jr., 4304 Autumn Leaves Dr., Tampa, Fla. 33624

[21] Appl. No.: 30,251

[22] Filed: Mar. 24, 1987

Related U.S. Application Data

[63] Continuation of Ser. No. 503,619, Jun. 13, 1983, abandoned.

[51] Int. Cl.[4] ..... F28F 7/00

[52] U.S. Cl. ..... 165/76; 165/158; 29/157.3 R

[58] Field of Search ..... 165/76, 81, 82, 158; 29/157.3

[56] References Cited

U.S. PATENT DOCUMENTS

| | | | |
|---|---|---|---|
| 1,511,836 | 10/1924 | Muhleisen | 165/82 |
| 1,737,849 | 12/1929 | Jacobsen | 165/82 |
| 1,994,779 | 3/1935 | McNeal | 165/82 X |
| 2,061,980 | 11/1936 | Price | 165/158 |
| 2,488,807 | 11/1949 | Currie | 165/82 |
| 2,783,980 | 3/1957 | Christensen | 165/158 |
| 2,956,787 | 10/1960 | Raub | 165/82 |
| 3,380,516 | 4/1968 | Kaye | 165/81 |
| 3,494,414 | 2/1970 | Warner | 165/82 |
| 3,526,275 | 9/1970 | Vance et al. | 165/158 |
| 3,669,185 | 6/1972 | Bare | 165/158 |
| 3,948,315 | 4/1976 | Powell | 165/158 X |
| 4,295,522 | 10/1981 | Frei | 165/158 X |

*Primary Examiner*—Ira S. Lazarus
*Assistant Examiner*—Peggy Neils
*Attorney, Agent, or Firm*—Frijouf, Rust & Pyle

[57] ABSTRACT

A disassembleable core heat exchanger is disclosed. The heat exchanger includes an elongated housing which defines a first passageway. A first end portion defines a second passageway which registers with the "passageway". A first tube retaining plate is metallurgically sealed within the first opening and a plurality of core tubes extend through and are sealingly engaged to the first tube retaining plate. The core tubes slidably extend through the passageway to a second tube retaining plate which is disposed remote from the first tube retaining plate. A first seal is disposed between the first end portion and the elongated housing. A second seal is disposed between a second end portion and the passageway. The second end portion cooperates with the second tube retaining plate. The two end portions are adjustably clamped relative each other to seal the second tube retaining plate relative to the elongated housing. A method of making the heat exchanger is also disclosed which includes cutting through one end of a conventional heat exchanger housing in the vicinity of the second tube retaining plate and cutting said second tube retaining plate circumferentially to separate the same from the housing and cutting through the opposite end of the housing to enable the removal of the tube core. A ring is slipped over the periphery of the second tube retaining plate and brazed thereto and a gasket is slipped over the tube core to form a seal between the first end portion and the elongated housing. An O-ring is slipped over the ring after the replacement of the core tubes within the housing. The O-ring seal forms a seal between the ring and the housing when the two end portions are moved towards each other by adjustable tie rods.

3 Claims, 5 Drawing Sheets

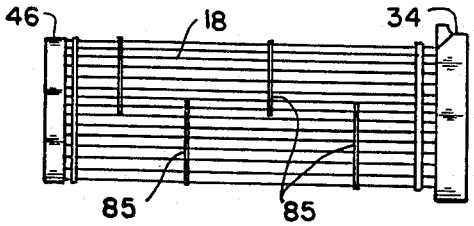
FIG. 14
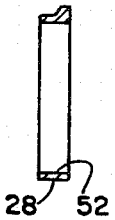
FIG. 15
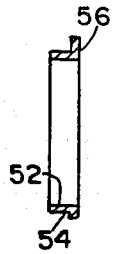
FIG. 16
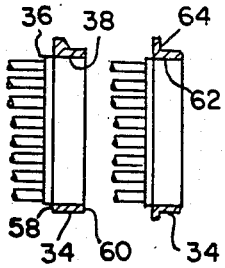
FIG. 17
FIG. 18
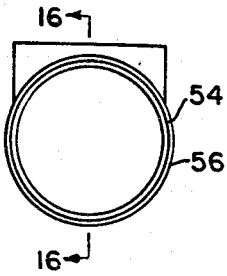
FIG. 19
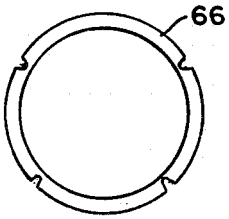
FIG. 20
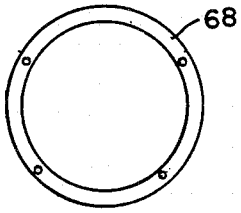
FIG. 21
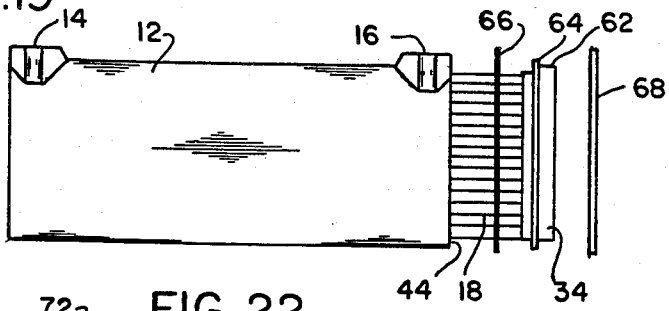
FIG. 22
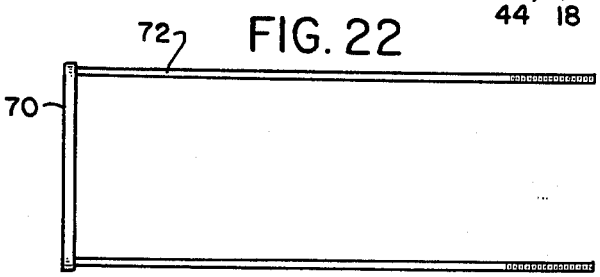
FIG. 23
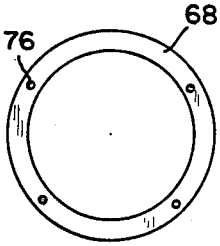
FIG. 24
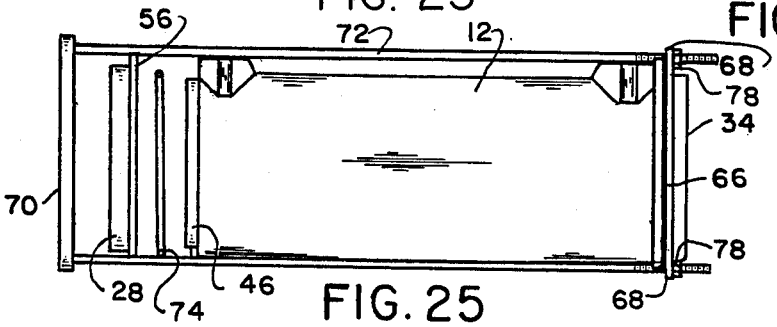
FIG. 25

DISASSEMBLEABLE CORE HEAT EXCHANGER

This application is a continuation of application Ser. No. 503,619, filed June 13, 1983, now abandoned, which is incorporated herein by reference as if fully set forth herein.

BACKGROUND OF THE INVENTION

1. Field of the Invention

This invention relates to disassembleable core heat exchangers. More specifically, the invention relates to disassembleable core heat exchangers for construction machinery, vehicles, trucks or the like.

2. Information Disclosure Statement

The standard procedure recommended in carrying out repairs on the engines, transmissions, and hydraulic systems of earth moving equipment is to replace the oil cooler heat exchanger. The replacement of these heat exchangers ensures that no contaminants find their way into the relatively complex and expensive mechanisms. However, the average cost of a replacement heat exchanger is currently in the region of $900.00. This high cost of replacement greatly increases the overall cost of repairing or overhauling the transmission on tractors and other excavating equipment.

In an article in the periodical *Caterpillar Engine News* dated July 8, 1976 under the caption "Install New Oil Coolers After a Component Failure", reference is made to the needed replacement as follows: "The engine, transmission and hydraulic systems are equipped with oil coolers. Many times a failure in these systems can put debris into the lubrication or hydraulic oil. This debris is then sent to and held by the oil coolers at their specific locations. No method is known to clean or flush this debris from the oil coolers. If a new oil cooler or core is not installed when repairs are made, it is possible for the debris to work loose and get into the lubricational hydraulic system. Debris held in the oil cooler may decrease oil flow and increase oil temperature and cause other failure.

"Inspection of the damaged parts, oil pump, filters, suction screens and sumps will give a good indication of the amount of debris in the oil system. If indications show a large amount of debris, then a new oil cooler or core should be installed according to replacement specifications. It is not necessary to install a new oil cooler or core at every failure, but it is a must when inspection shows large amounts of debris in the oil system.

"The service life of a rebuilt engine, transmission or hydraulic system can be extended if a new oil cooler or core is installed when the rebuilt component is installed. If a new oil cooler or core is installed at the time of rebuilding, then debris from the previous failure cannot re-enter the lubrication system."

The present invention has as its primary objective the overcoming of this expensive replacement of heat exchangers for engines, transmissions and other hydraulic systems.

The disassembleable core heat exchanger of the present invention overcomes the aforementioned inadequacies of the prior art devices by providing a core that can be readily removed from the heat exchanger housing for cleaning and removal of debris therefrom and which is able to be reassembled without need of expensive replacement thereof.

Another object of the invention is the provision of a heat exchanger having an elongated housing and two cooperating end portions disposed at opposite ends of the housing and a removable core of tubes slidably disposed within the housing.

Another object of the invention is the provision of a pair of collars, each collar associated with a respective end portion, the collars being adjustably moveable relative each other to seal the core tubes relative the elongated housing.

Another object of the present invention is the provision of a plurality of threaded tie rod ends disposed between the collars for adjusting the relative disposition of the collars and associated end portions.

A further objective of the present invention is to provide a method of making a disassembleable heat exchanger which includes the steps of cutting through one end of the housing in the vicinity of the second tube retaining plate and cutting said second tube retaining plate circumferentially to separate the same from the housing, cutting transversely through the other end of the housing to permit one end portion and attached core tubes to be slid out of the housing, providing a ring around the periphery of the second tube retaining plate and replacing the core tubes within the housing.

Another object of the present invention is the provision of a method of making a disassembleable heat exchanger in which a gasket or seal is disposed between the end portion and the housing and a seal is provided around the ring to form a seal between the ring and the housing.

A further object of the present invention is the provision of a heat exchanger in which, in addition to the provision of a brazed ring disposed around the second tube retaining plate, the opposite end of the housing is transversely cut in the vicinity of the first tube retaining plate. The first tube retaining plate is then cut circumferentially to enable separation of the first tube retaining plate and the core tubes from the housing. A brass or copper flange having a central aperture corresponding with the diameter of the cut first tube retaining plate is slipped over the first tube retaining plate and brazed thereto. A gasket or seal is slipped over the core tubes and positioned to form a seal between the brass or copper flange and the housing on reassembly of the core tubes with the housing.

Another object of the present invention is the provision of a removable core cooler, the configuration of which makes possible the repair of the same.

Another object of the present invention is the provision of a method of repairing the effects of fretting corrosion partially due to vibration between the core tubes and supporting baffles.

Another object of the present invention is the provision of a replaceable core configuration which facilitates the replacement of a leaking core tube.

The foregoing has outlined some of the more pertinent objects of the present invention. These objects should be construed to be merely illustrative of some of the more pertinent features and applications of the invention. Many other beneficial results can be attained by applying the disclosed invention in a different manner or modifying the invention within the scope of the disclosure. Particularly, with regard to the use of the invention described herein, this should not be construed to be limited to heat exchangers for oil coolers but should include heat exchangers for all engines, transmissions, hydraulic systems and the like.

SUMMARY OF THE INVENTION

The heat exchanger of the present invention is defined by the appended claims with specific embodiments shown in the attached drawings. For the purpose of summarizing the invention, the invention relates to heat exchangers for oil coolers, for engines, transmissions and hydraulic systems or the like. The disassembleable core heat exchanger includes an elongated housing having a first passageway defined thereby. The passageway extends along the length of the housing between a first and a second end thereof. A first end portion defines a first opening, the first end of which cooperates with the first end of the passageway. A first tube retaining plate is disposed within the first opening and is metallurgically sealed to the first end portion. The first tube retaining plate defines a plurality of apertures through which a corresponding plurality of core tubes extend. The core tubes are sealed relative to the first tube retaining plate. A second tube retaining plate is disposed at the opposite end of the core tubes and includes a plurality of apertures defined thereby. The tubes extend through and are sealed to the second tube retaining plate. A second end portion cooperates with the second end of the passageway and defines a third passageway which slidably receives the second tube retaining plate therein. A first seal disposed between the first end of the first end portion and the first end of the passageway seals the first end portion to the housing.

A second seal is disposed around a ring located around and brazed to the second tube retaining plate. The second seal is located between the second end of the passageway and the second end portion. An adjustable clamp adjustably locates the relative disposition of the two end portions to seal the core tube relative to the housing.

In a more specific embodiment of the invention, the first seal is a gasket and the second seal is an O-ring. The adjustable clamp includes a pair of collars, each of which respectively cooperates with a radially extending flange formed on each of the end portions. Threaded tie rods extend through the collars and are adjusted to locate the relative disposition of the end portions.

The method of making the heat exchanger includes cutting through the second end of the elongated housing in the vicinity of the second tube retaining plate and cutting the second tube retaining plate circumferentially to separate the same from the housing. After cleaning the removed core tubes, a gasket or seal is placed over the core tubes and is positioned adjacent the first end portion. A ring is slipped over the second tube retaining plate and is brazed to the same. The internal surface of the second end portion is ground to remove the remains of the original tube retaining plate. The first and the second end portions are externally machined to provide a radially extending flange on each of the end portions. The core tubes are slid back into the elongated housing until the gasket or seal is disposed between the first end of the passageway and the first end portion. An O-ring is slipped over and around the ring which partially protrudes from the elongated housing. The second end portion is positioned adjacent the second end of the passageway and the collars are positioned over the first and second end portions, respectively, such that they abut respectively against the radially extending flanges. The threaded rods are adjusted to alter the relative disposition of the two end portions to seal the core tubes relative to the elongated housing and form a seal between the ring and the housing.

In an alternative embodiment, both ends of the elongated housing are transversely cut through in the vicinity of the tube retaining plates. The second tube retaining plate is cut circumferentially and a ring is slipped over the second tube retaining plate and brazed to the same. The first tube retaining plate is also cut circumferentially and a brass or copper flange having an aperture which corresponds with the diameter of the first tube retaining plate is slipped over the first tube retaining plate and brazed thereto. The core tube is slid back into the elongated housing with the gasket or seal disposed between the first tube retaining plate and the flange of the housing. An O-ring is disposed around the protruding end of the ring and a retainer plate is positioned adjacent the O-ring to urge the O-ring into engagement between the ring and the elongated housing.

In a modification of the preferred embodiment and the alternative embodiment, a counterbore coaxial with the passageway is defined by the second end of the housing. This counterbore partially receives the O-ring therebetween.

The foregoing has outlined rather broadly the more pertinent and important features of the present invention in order that the detailed description of the invention which follows may be better understood, and so that the present contribution to the art can be more fully appreciated. Additionally, features of the invention disclosed will be disclosed or described hereinafter that form the subject of the claims of the invention. It should be appreciated by those skilled in the art that the conception and specific embodiment disclosed may be readily utilized as a basis for modifying or designing other devices for carrying out the same purposes as the present invention. It should be realized by those skilled in the art that such equivalent constructions do not depart from the spirit and scope of the invention as set forth in the appended claims.

BRIEF DESCRIPTION OF THE DRAWINGS

For further understanding of the nature and objects of the invention, reference should be had to the following description taken in conjunction with the accompanying drawings in which:

FIG. 14 is a side elevational view of the first end portion and attached core tubes with the ring brazed to the second tube retaining plate;

FIG. 15 is a cross sectional view of the second end portion which has been cut off from the elongated housing;

FIG. 16 is a cross sectional view taken on the line 16—16 of FIG. 19 showing the second end portion externally machined to provide a radially extending flange thereon;

FIG. 17 is a fragmentary side elevational view partially in section of the first end portion and attached core tubes removed from the elongated housing;

FIG. 18 shows the first end portion externally machined to provide a radially extending flange thereon;

FIG. 19 is an end view of the second end portion after external machining;

FIG. 20 is an end view of the first seal;

FIG. 21 is an end view of one of the collars;

FIG. 22 is a side elevational view of the heat exchanger partially reassembled;

FIG. 23 is a side elevational view of one of the collars and attached threaded tie rods;

FIG. 24 is an end view of a collar which cooperates with the tie rods shown in FIG. 23;

FIG. 25 is a side elevational view partially in section of the core tubes reassembled within the elongated housing and with the second seal ready to be positioned around the ring;

Similar reference characters refer to similar parts throughout the several views of the drawings.

DETAILED DESCRIPTION

Figure 1:
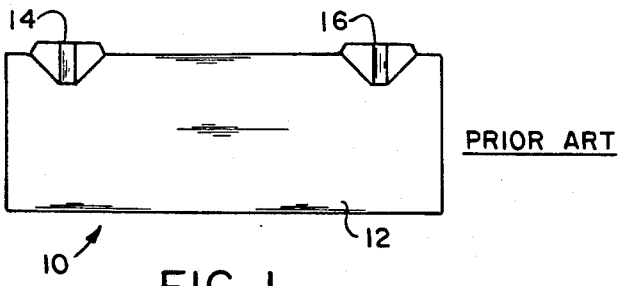
FIG. 1 is a side elevational view of a conventional heat exchanger known in the art.
Figure 2:
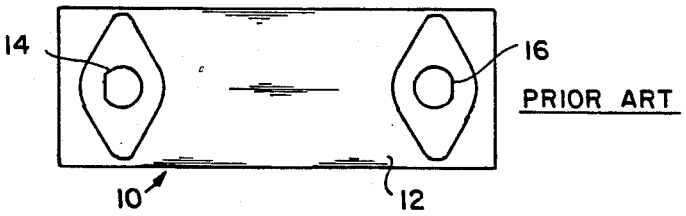
FIG. 2 is a top plan view of the heat exchanger of FIG. 1.

FIG. 1 is a side elevational view of a conventional heat exchanger or oil cooler generally designated 10. The heat exchanger includes an elongated housing 12 and an oil inlet 14 and an oil outlet 16. FIG. 2 is a top plan view showing the inlet and outlet 14 and 16, respectively.

Figure 3:
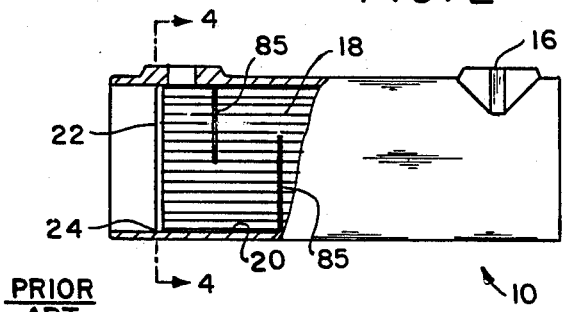
PRIOR ART FIG. 3
FIG. 3 is a side elevational view partially in section of the heat exchanger of FIG. 1.

FIG. 3, which is a side elevational view of the heat exchanger 10 partially in section, shows the core tubes 18 disposed within a passageway 20 of the elongated housing 12. A second tube retaining plate 22 is disposed in sealing engagement with the ends of the core tubes 18 and is metallurgically sealed at 24 within the passageway 20.

Figure 4:
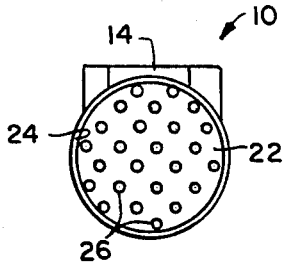
FIG. 4 PRIOR ART
FIG. 4 is a cross sectional view taken on the line 4—4 of FIG. 3.

FIG. 4 is a cross sectional view taken on the line 4—4 of FIG. 3 and shows the second tube retaining plate 22 disposed within the passageway 20 and metallurgically sealed to the passageway 20 at 24. The metallurgical seal extends around the periphery of the plate 22. A plurality of apertures 26 are defined by the plate 22 and these apertures 26 receivably engage the ends of the core tubes 18 and are sealed thereto.

Figure 5:
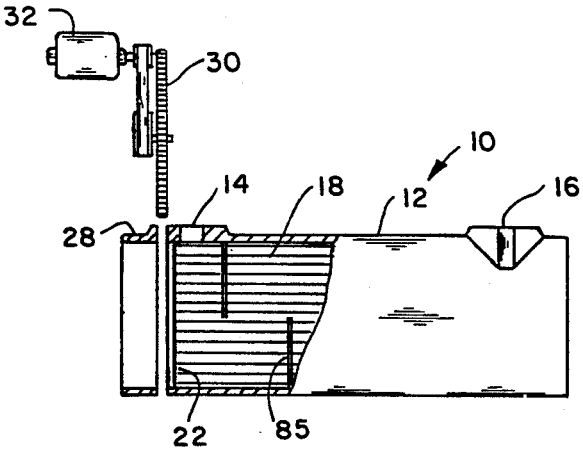
FIG. 5 is a side elevational view partially in section showing the second end portion of the heat exchanger cut off from the elongated housing.

FIG. 5 is a side elevational view of the heat exchanger 10 partially in section showing the second end portion 28 having been cut off from the elongated housing 12 by means of a suitable cutting blade 30 rotated by means of a motor 32. The cutting blade 30 severs the elongated housing 12 from the second tube retaining plate 22. This cutting process is carefully controlled to slightly reduce the diameter of the second tube retaining plate 22 without disturbing the seals between the core tubes 8 and the second tube retaining plate 22.

Figure 6:
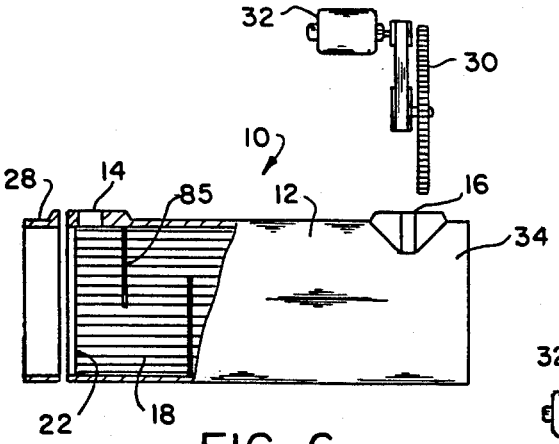
FIG. 6 is a side elevational view of the heat exchanger partially in section showing the cutting blade positioned to cut through the elongated housing adjacent the first end portion.

FIG. 6 illustrates the cutting blade 30 being moved longitudinally relative the elongated housing 12 and ready to cut through the elongated housing in the vicinity of the first tube retaining plate between the elongated housing 12 and the first end portion 34.

Figure 7:
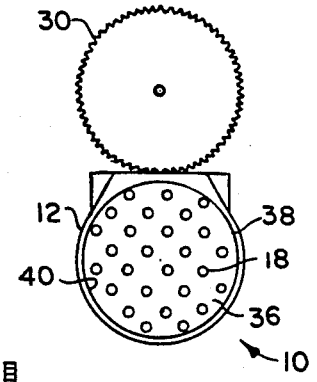
FIG. 7 is an end view of the heat exchanger showing the cutting blade cutting through the elongated housing to remove the first end portion and tube core.

As shown more clearly in FIG. 7 and in a manner similar to FIG. 5, the cutting blade 30 only cuts through the elongated housing 12 and does not cut through any of the plurality of core tubes 18. The core tubes 18 are left attached to a first tube retaining plate 36 which is metallurgically sealed to a second passageway 38 defined by the first end portion 34. The first tube retaining plate 36 is sealed around the periphery thereof to a first opening 38 by the metallurgical seal 40.

Figure 8:
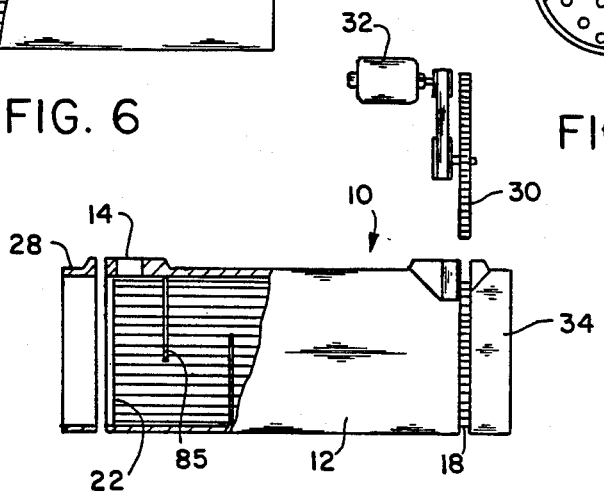
FIG. 8 is a side elevational view partially in section showing the elongated housing having been cut through adjacent the first end portion to enable the core tubes to be removed from the elongated housing.

FIG. 8 is a fragmentary side elevational view of the heat exchanger partially in section showing the first end portion 34 separated from the elongated housing 12 and exposing the plurality of core tubes 18.

Figure 9:
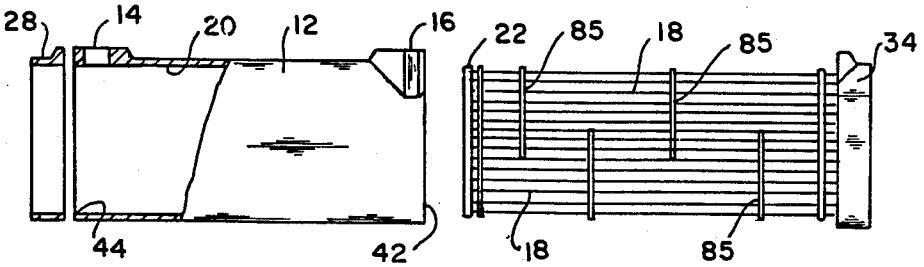
FIG. 9 is a side elevational view of the heat exchanger partially in section showing the first end portion and attached core tubes removed from the elongated housing.

FIG. 9 which is partially in section shows the first end portion 34 and attached core tubes 18 and the second tube retaining plate 22 removed from the elongated housing 12. The passageway 20 extends along the entire length of the elongated housing between the first end 42 to the second end 44 thereof.

Figures 10, 11, 12, 13:
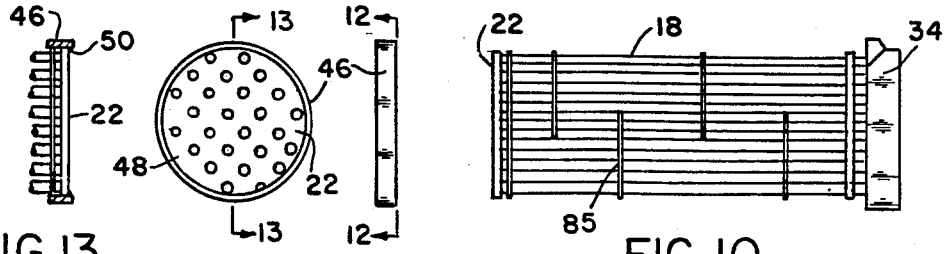
FIG. 10 is a side elevational view of the first end portion and attached core tubes.
FIG. 11 is a side elevational view of the ring.
FIG. 12 is a sectional view taken on the line 12—12 of FIG. 11 but with the ring brazed to the second tube retaining plate.
FIG. 13 is a sectional view taken on the line 13—13 of FIG. 12.

FIG. 10 is a side elevational view of the first end portion 34 and attached core tubes 18. A ring 46 of brass or copper shown in FIG. 11 has an internal diameter slightly greater than the external diameter of the second tube retaining plate 22. The ring 46 is slipped over the second tube retaining plate 22 and brazed thereto.

FIG. 11 shows the ring 46 which is to be brazed to the second tube retaining plate.

FIG. 12 is a section taken on the line 12—12 of FIG. 11 and shows the ring 46 brazed to the second tube retaining plate 22 which defines a plurality of apertures 48 corresponding with a number of core tubes 18.

As shown more particularly in FIG. 13, the second tube retaining plate 22 is encircled by the ring 46 which is brazed at 50 to the second tube retaining plate 22. The plurality of core tubes 18 extend through the apertures 48 in the second tube retaining plate 22 and are sealed thereto as shown in FIG. 14.

FIG. 15 shows the second end portion 28 which is internally ground to remove the peripheral remains of the second tube retaining plate 22. When the second end portion 28 has been internally ground to provide a third passageway 52 defined by the second end portion 28, the second end portion is then externally machined to provide a cylindrical portion 54 and a radially extending flange 56 as shown in FIG. 16.

FIG. 17 shows in more detail the internal construction of the first end portion 34 which defines the first opening 38. The passageway 38 extends between a first end 58 and a second end 60 of the first end portion 34. The first tube retaining plate 36 is metallurgically sealed to the first opening 38.

As shown in FIG. 18, the first end portion 34 is externally machined to provide a cylindrical portion 62 and a radially extending first flange 64.

FIG. 19 is an end view of the second end portion 28 showing the cylindrical portion 54 and second flange 56. FIG. 20 is an end view of the first seal 66 in the form of a gasket. FIG. 21 is an end view of one of the collars which cooperates with the cylindrical portion of the end portions.

FIG. 22 shows the core tubes 18 partially reassembled within the elongated housing 12 with the gasket or first seal 66 interposed between the second end 44 of the passageway 20 and the first flange 64 of the first end portion 34.

FIG. 23 shows another collar 70 having a plurality of tie rods 72 extending therefrom. The collar 70 is slipped over the cylindrical portion 54 of the second end portion 28 until it abuts against the second flange 56 and cooperates with collar 68 shown in FIG. 24.

Figure 26:
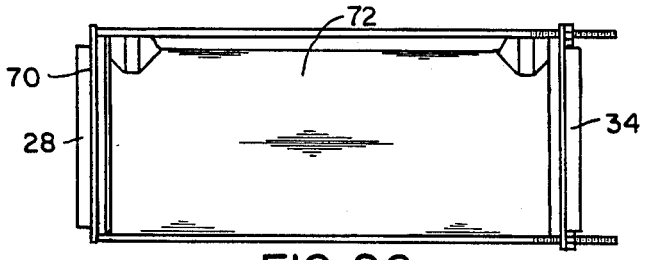
FIG. 26 is a side elevational view of the reassembled heat exchanger partially in section showing the two end portions adjustably clamped relative each other.
Figure 27:
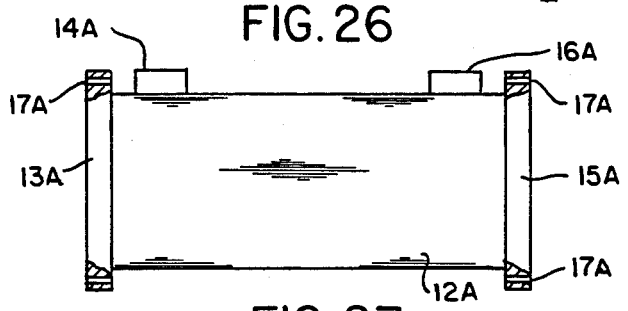
FIG. 27 is a side elevational view partially in section of an alternative embodiment of the present invention.

As shown in FIG. 25, an elastomeric O-ring 74 which forms a second seal is slipped over and around the protruding end of the ring 46. The second end portion 28 is moved longitudinally until the second flange 56 abuts against the O-ring 74. The other collar 68 is slipped over the cylindrical portion 62 of the first end portion and the tie rods 72 are located within corresponding apertures 76 defined by the collar 68. Nuts 78 are threaded onto the threaded ends of the tie rods 72 to adjustably clamp the first end portion relative to the second end portion and to engage the second seal into engagement, respectively, with the ring 46 and the elongated housing 12. FIG. 26 shows the heat exchanger in assembled form.

The method of making the disassembleable core heat exchanger of the present invention involves the steps of cutting through the elongated housing 12 in the vicinity of the second tube retaining plate and removing the second end portion 28 therefrom. The cutting is accomplished by means of the cutting blade 30 or any other suitable cutting means such as a powered hacksaw blade or the like. The cut is made transverse to the longitudinal axis of the housing 12. The cut through the housing 12 is carefully controlled to slightly reduce the diameter of the second tube retaining plate without disturbing the seals between the core tubes 18 and the second tube retaining plate 22.

The cutting blade 30 is next positioned adjacent the opposite end of the elongated housing 12 in the vicinity of the first tube retaining plate and is positioned such that it will circumferentially cut through the elongated housing 12 but slightly towards the middle of the housing 12 to permit the first end portion 34 and the attached core tubes 18 to be slidably removed from the housing 12.

Cleaning and treating of the core tubes is carried out subsequent to removal of the same from the housing 12. Additionally, tests can be carried out to check for the presence of minute holes in the core tubes 18.

The second end portion 28 is internally ground to remove any peripheral remains of the second tube retaining plate and metallurgical weld disposed on the internal surface of the portion 28.

The second end portion 28 is then externally machined to provide the cylindrical portion 54 and the radially extending second circumferential flange 56 thereon. The first end portion 34 is externally ground to provide the cylindrical portion 62 and the radially extending first circumferential flange 64 thereon.

The second tube retaining plate 22 and brazed ring 46 and attached core tubes 18 are passed through the first seal or gasket 66 and the plate 22, ring 46 and tubes 18 are reassembled within the housing 12 until the seal 66 is disposed between the first flange 64 and the first end 42 of the passageway 20.

The second seal or elastomeric O-ring 74 is slipped over the protruding end of the ring 46. The second flange 56 is located adjacent the second seal 74 and adjustably clamps the end portions 28 and 34 relative each other to form a seal between the first end portion and the first end of the housing and between the ring 46 and the second end of the housing, respectively.

More specifically, the adjustable clamping means involves placing the collar 70 with attached tie rods 72 over the cylindrical portion 54 and placing the other collar 68 over the cylindrical portion 62, locating the ends of the tie rods 72 within the apertures 76 and capturing the collar 68 by means of the nuts 78 which cooperate with the threaded tie rods 72.

Figure 28:
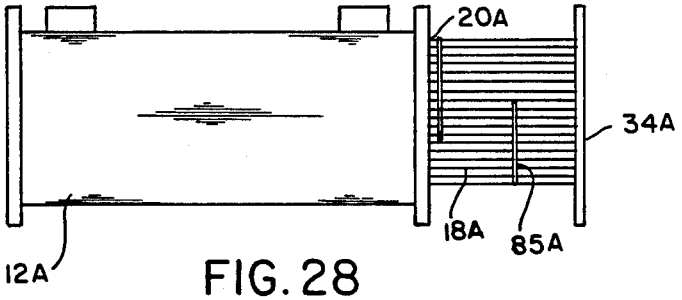
FIG. 28 is a side elevational view of the embodiment of FIG. 27 showing the first end portion and attached core tubes partially removed from the elongated housing.
Figure 29:
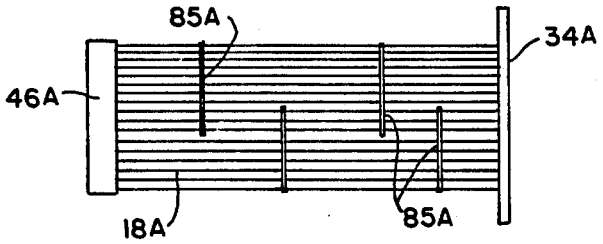
FIG. 29 is a side elevational view of the core tubes with a ring brazed onto the second tube retaining plate and a flange brazed onto the first tube retaining plate.
Figure 30:
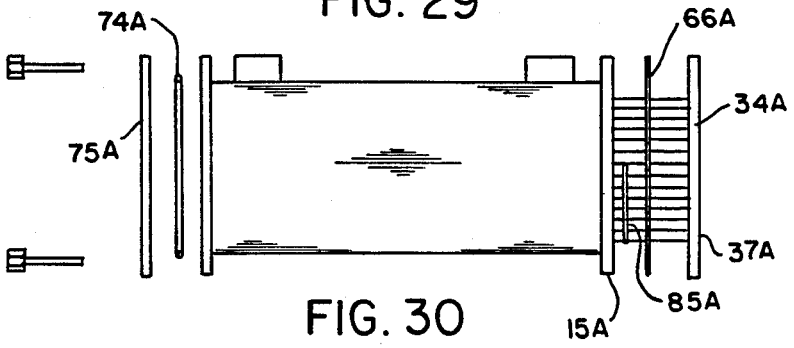
FIG. 30 is an exploded view of the heat exchanger shown in FIG. 28 with the first seal located between the brazed flange and the first end of the first passageway.
Figure 31:
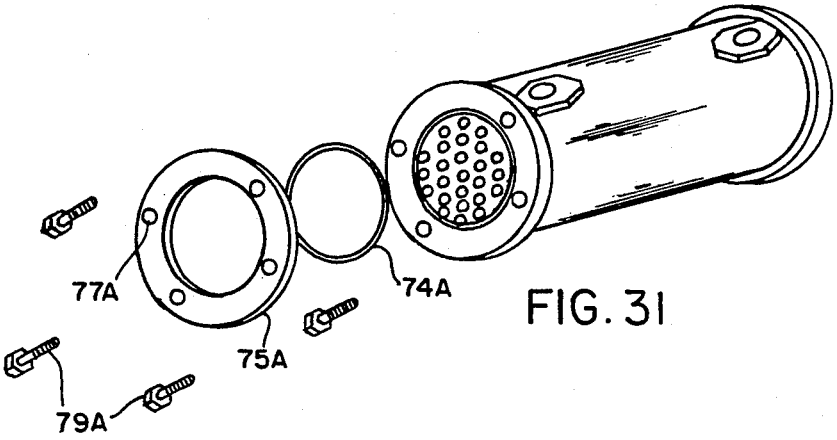
FIG. 31 is an exploded perspective view of the heat exchanger showing the O-ring ready to be slipped over the protruding end of the ring.

In an alternative embodiment of the present invention as shown in FIGS. 27–32, the elongated housing 12A includes an oil inlet 14A and an oil outlet 16A. The housing 12A includes a flange 13A adjacent one end thereof and a flange 15A adjacent the other end. Each flange 13A and 15A includes apertures 17A defined by the flanges 13A and 15A, respectively. The flange 13A is cut through in the vicinity of the second tube retaining plate as shown in FIG. 28 by the cutting blade 30A (not shown). The flange 15A is then cut through in the vicinity of the first tube retaining plate and transversely to the longitudinal axis of the housing 12A. The flange 15A is cut slightly towards the middle of the housing 12A so as not to disturb the metallurgical seal between the first tube retaining plate and the first end portion 34A of the flange. This cutting through of the flange 15A is accomplished without cutting through the core tubes 18A. The core tubes 18A and attached first end portion 34A are slidably removed from the passageway 20A of the housing 12A.

With the first end portion 34A and attached core tubes 18A removed from the housing 12A, the second tube retaining plate is slipped into a ring 46A. A gasket or seal 66A is slipped over the ring 46A and core tubes 18A and the ring 46A and core tubes 18A are replaced with the housing 12A such that the gasket 66A is disposed between the first end of the passageway 20A and the flange 34A.

An O-ring or second seal of elastomeric materials 74A is slipped over the protruding portion of a ring 46A which is slipped over and brazed to the second tube retaining plate. The second seal 74A is urged between the ring 46A and the housing 12A by means of a locating plate 75A provided with a plurality of apertures 77A and cooperating bolts 79A. The bolts 79A adjustably urge the locating plate 75A against the O-ring 74A.

The removable core cooler of the present invention makes possible the repair of coolers and heat exchangers where replacement of the same would otherwise be required.

In the event of a leak being detected in the metallurgical seal of one of the tube retaining plates, this metallurgical seal would be selected to be cut and replaced with a brazed ring and O-ring seal.

If both tube retaining plates are found to be leaking, both metallurgical seals can be cut and replaced by brazed rings or end portions.

Fretting corrosion of the core tubes at the supporting baffles is arrested by soldering the tubes at the joints between the tubes and associated baffles or by immersing the removable core tubes in a solder bath. This eliminates vibration-induced fretting corrosion between the core tubes and the supporting baffles 85 and 85A, respectively.

On removal of the core tubes from the housing, if one or more core tubes is detected as leaking, the defective tube is drilled free from both tube retaining plates and removed from the core. A replacement tube can be brazed or soldered to the tube retaining plates with no danger of interfering with the seals between the tube retaining plates and the housing.

Figure 32:
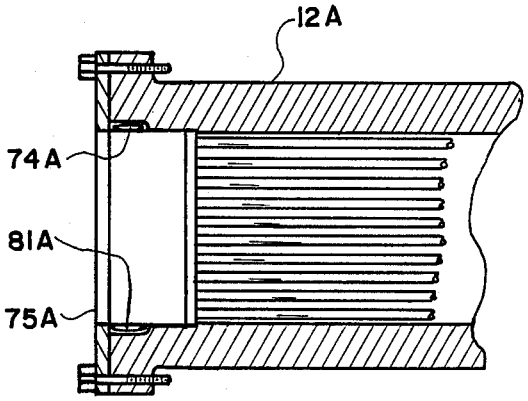
FIG. 32 is a sectional view of a modification of the alternative embodiment showing a counterbore of the passageway.

As in the case of the preferred embodiment, the passageway may include counterbore 81A which houses the O-ring 74A as shown in FIG. 32.

The present invention provides not only a core heat exchanger that is easily disassembled for rountine maintenance and testing but also a method of making a disassembleable heat exchanger that avoids the costly requirement of replacing an expensive heat exchanger unit as has been the custom in the prior art.

The present disclosure includes that contained in the appended claims as well as that of the foregoing description. Although the invention has been described in its preferred form with a certain degree of particularity, it is understood that the present invention of the preferred form has been made only by way of example, that numerous changes in the details of construction and the combination and arrangement of parts may be resorted to without departing from the spirit and scope of the invention.

What is claimed is:

1. A dissassembleable core heat exchanger for enabling the exchange of heat between a first fluid and a second fluid and for permitting dissassembly of the core heat exchanger, the heat exchanger being interposed between a first coupling and a second coupling, comprising:

an elongated housing having a passageway extending therethrough between a first end and a second end;

a first housing port and a second housing port located proximate said first and said second elongated housing ends for permitting the flow of the first fluid therebetween;

a heat exchanger core comprising a first tube retaining plate and a second tube retaining plate and a plurality of core tube fore permitting the flow of the second fluid therethrough;

each core tube of said plurality of core tubes having a first end and a second end defining opposed ends;

each of said first and said second tube retaining plates having a plurality of apertures for sealingly engaging with said opposed ends of said plurality of core tubes;

said heat exchanger core being disposed within said passageway of said elongated housing with said first and said second retaining plates being located adjacent said first and second ends of said elongated housing, respectively;

means for sealing said first ends of said plurality of core tubes from said passageway of said elongated housing when said first end of said elongate housing is secured to the first coupling;

a ring secured to the periphery of said second tube retaining plate which extends rearwardly relative to said retaining plate such that when said core is disposed within said passageway of said elongated housing said ring partially protrudes relative to said second end of said elongated housing for defining an inner O-ring sealing surface positioned directly opposite the periphery of said second tube retaining plate;

an O-ring seal disposed around said inner O-ring sealing surface;

a locating plate disposed adjacent said second end of said elongated housing and engaging said O-ring for defining an outer O-ring sealing surface; and said O-ring sealingly engaging said locating plate, said second end of said elongated housing and said ring secured to the periphery of said second tube retaining plate when said second end of said elongated housing is secured to the second coupling thereby sealing said second ends of said plurality of core tubes from said passageway of said elongated housing and providing a first flow path between said first and second housing ports for the first fluid independent of a second flow path between the first and the second couplings for the second fluid.

2. A dissassembleable core heat exchanger for enabling the exchange of heat between a first fluid and a second fluid and for permitting dissassembly of the core heat exchanger, the heat exchanger being interposed between a first coupling and a second coupling, comprising:

an elongated housing having a passageway extending therethrough between a first end and a second end;

a first housing port and a second housing port located proximate said first and said second elongated housing ends for permitting the flow of the first fluid therebetween;

a heat exchanger core comprising a first tube retaining plate and a second tube retaining plate and a plurality of core tubes for permitting the flow of the second fluid therethrough;

each core tube of said plurality of core tubes having a first end and a second end defining opposed ends;

each of said first and said second tube retaining plates having a plurality of apertures for sealingly engaging with said opposed ends of said plurality of core tubes;

said heat exchanger core being disposed within said passageway of said elongated housing with said first and said second retaining plates being located adjacent said first and second ends of said elongated housing; respectively;

a first flange secured to said first tube retaining plate and extending radially therefrom;

a first gasket disposed around said plurality of core tubes and interposed between said first flange and said first end of said passageway of said elongated housing for sealing said first ends of said plurality of core tubes from said passageway of said elongated housing when said first end of said elongated housing is secured to the first coupling;

a ring secured to the periphery of said second tube retaining plate which extends rearwardly relative to said retaining plate such that when said core is disposed within said passageway of said elongated housing said ring partially protrudes relative to said second end of said elongated housing for defining an inner O-ring sealing surface positioned directly opposite the periphery of said second tube retaining plate;

an O-ring seal disposed around said inner O-ring sealing surface;

a locating plate disposed adjacent said second end of said elongated housing and engaging said O-ring for defining an outer O-ring sealing surface; and said O-ring sealingly engaging said locating plate, said second end of said elongated housing and said ring secured to the periphery of said second tube retaining plate when said second end of said elongated housing is secured to the second coupling thereby sealing said second ends of said plurality of core tubes from said passageway of said elongated housing and providing a first flow path between said first and second housing ports for the first fluid independent of a second flow path between the first and the second couplings for the second fluid.

3. The dissassembleable core heat exchanger as set forth in claim 2, wherein said second end of said elongate housing includes a counterbore coaxial with said passageway of said elongated housing to partially receive said O-ring between said ring secured to the periphery of said second tube retaining plate and said counterbore of said elongated housing to sealingly engage said ring, said counterbore and said locating plate when said second end of said elongated housing is secured to the second coupling.

* * * * *

UNITED STATES PATENT AND TRADEMARK OFFICE

CERTIFICATE OF CORRECTION

PATENT NO. : 4,773,475

DATED : September 27, 1988

INVENTOR(S) : Robert E. Sleep, Jr.

It is certified that error appears in the above-identified patent and that said Letters Patent are hereby corrected as shown below: Title page:

In the Abstract

Line 3, delete "first" (first occurrence).

Line 4, delete "second passageway" and insert therefor --first opening--.

Line 4, delete the quotation marks around "passageway".

In the Specification

Column 6, line 40, delete "second passageway" and insert therefor --first opening--.

Signed and Sealed this

Seventh Day of March, 1989

*Attest:*

DONALD J. QUIGG

*Attesting Officer*

*Commissioner of Patents and Trademarks*